US005531190A

United States Patent [19]

Mork

[11] Patent Number: 5,531,190

[45] Date of Patent: Jul. 2, 1996

[54] ELECTROHYDRAULIC FAN CONTROL

[75] Inventor: David A. Mork, Ames, Iowa

[73] Assignee: Sauer Inc., Ames, Iowa

[21] Appl. No.: 348,319

[22] Filed: Dec. 9, 1994

[51] Int. Cl.[6] ..... F01P 7/02

[52] U.S. Cl. ..... 123/41.12

[58] Field of Search ..... 123/41.12

[56] References Cited

U.S. PATENT DOCUMENTS

| | | | |
|---|---|---|---|
| 4,348,990 | 9/1982 | Nolte et al. | 123/41.12 |
| 5,165,377 | 11/1992 | Hosseini | 123/41.12 |
| 5,216,983 | 6/1993 | Nilson | 123/41.12 |
| 5,359,969 | 11/1994 | Dickrell et al. | 123/41.12 |

FOREIGN PATENT DOCUMENTS 2191847 3/1987 United Kingdom .

OTHER PUBLICATIONS

Technical Paper entitled "SAE Technical Paper Series" dated Sep. 1985—See particularly page 101, paragraph 6).

*Primary Examiner*—Noah P. Kamen

*Attorney, Agent, or Firm*—Zarley, McKee, Thomte, Voorhees & Sease

[57] ABSTRACT

An electrohydraulic fan control system includes an engine, a hydraulic pump, hydraulic lines, a hydraulic cooling fan, and a solenoid controlled hydraulic valve. The engine includes an electronic control circuit which generates a control signal based on various temperature sensors which is used by the hydraulic valve to control the speed of the cooling fan.

15 Claims, 1 Drawing Sheet

ELECTROHYDRAULIC FAN CONTROL

FIELD OF THE INVENTION

The present invention relates to a variable speed hydraulic motor for driving a cooling fan for an internal combustion engine. More particularly, the present invention relates to a hydraulic motor for driving a cooling fan whose speed is determined by a solenoid controlled hydraulic valve which is in turn controlled by an electronic signal generated by the engine control processor.

PROBLEMS IN THE ART

Hydraulic cooling fans for cooling an internal combustion engine are well known in the art. Typically, cooling systems are inefficient from power consumption and noise reduction aspects. One reason for their inefficiency is that cooling systems are designed to overcool an engine to ensure adequate cooling of the engine under all conditions. Typically, the fans are operated at a constant speed relative to the engine. However, under most conditions, adequate cooling could be obtained without the fan operating at its maximum speed. Therefore, it is desired to a control system to control the fan speed. Another disadvantage to running a cooling fan at full speed is the noise that it creates. In large engines, such as used in a bus, it is desired to have as little noise as possible.

One prior art solution to these problems is to use electrically driven cooling fans that cycle on and off at predetermined water temperatures. However, these systems are generally limited to engines having low horse power such as small automobiles. For engines having a higher horse power, a different system is desirable. Typically, higher powered engines use hydraulic cooling fans rather than electric ones. The reason that electric cooling fans are not considered a practical solution for large vehicles is that the electric motor may draw several hundred amps, putting a severe strain on the vehicle's electrical system. Also, the physical size of an adequate electric fan motor is prohibitively large compared to an adequate hydraulic fan motor. Similarly, pneumatic motor systems are also physically oversized. Devices such as clutch drives, pneumatic drives, electromagnetic drives, and viscous drives can all be thermostatically controlled but must be driven by some mechanical means, for example, belts, splined shafts, or chains, etc. Also, these devices can not be installed in a location that is not very close to the engine. On the other hand, a hydraulic motor can be installed at some distance from the engine.

One prior art system using a hydraulic cooling fan includes a thermostatic valve whose operation depends on the temperature of the engine. The thermostatic valve in turn controls the speed of the cooling fan. This system includes two valves. First, a thermostatic valve houses a wax filled capsule for controlling the pilot pressure of the hydraulic lines. Second, a switching valve is modularly mounted to the fan motor and responds to the pilot command from the thermostatic valve. The switching valve limits motor inlet pressure and consequently the fan speed to a level proportional to the engine coolant temperatures. The thermostatic valve is mounted adjacent to the engine coolant such that the temperature of the coolant makes the wax in the wax filled capsule to expand or contract which controls the position of the thermostatic valve. The thermostatic valve device has several disadvantages. The thermostatic valve is only responsive to one temperature source from the engine, usually the engine coolant. It would be desirable to use a plurality of temperature sources in controlling the cooling fan. Also, the wax capsule device can be unreliable. Another disadvantage is that the hydraulic lines must be installed along the entire distance from the temperature source to the switching valve on the hydraulic motor.

FEATURES OF THE INVENTION

A primary feature of the present invention is the provision of an electrohydraulic fan control system that facilitates efficient and quiet operation of a hydraulic cooling fan.

A further feature of the present invention is the provision of an electrohydraulic fan control system which utilizes an existing electronic signal from the engine control processor to control the speed of a cooling fan.

A further feature of the present invention is the provision of an electrohydraulic fan control system which can be responsive to a plurality of temperature sources.

A further feature of the present invention is the provision of an electrohydraulic fan control system which can be controlled by a pulse width modulated signal.

These as well as other features of the present invention will become apparent from the following specification and claims.

SUMMARY OF THE INVENTION

An electrohydraulic controlled cooling system of the present invention includes an internal combustion engine, a hydraulic pump, various hydraulic lines, a hydraulic cooling fan, and a solenoid controlled hydraulic valve. The system of the present invention senses at least one engine condition, such as temperature, and generates an electronic signal based on the engine condition. The electronic signal is used by a circuit actuate a solenoid controlled hydraulic valve which in turn controls the amount of hydraulic fluid that flows through the hydraulic cooling fan, therefore controlling the speed of the fan.

When a maximum amount of cooling is desired, the electronic signal is such that the circuit makes the solenoid controlled valve direct a maximum amount of hydraulic fluid to the cooling fan resulting in the fan's maximum operating speed. Conversely, when a minimum amount of cooling is desired, the electronic signal is such that the circuit makes the solenoid controlled valve direct a minimum amount of hydraulic fluid to the cooling fan resulting in the fan's minimum operating speed. Any number of desired intermediate fan speeds can also be obtained through use of the present invention.

DETAILED DESCRIPTION OF THE PREFERRED EMBODIMENT

The present invention will be described as it applies to its preferred embodiment. It is not intended that the present invention be limited to the described embodiment. It is intended that the invention cover all alternatives, modifications, and equivalencies which may be included within the spirit and scope of the invention.

Figure 1:
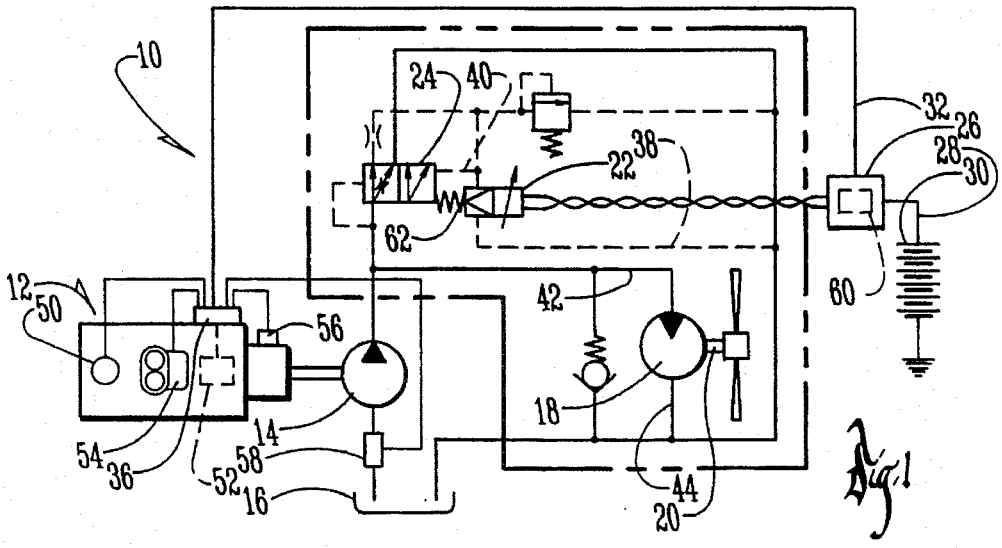
FIG. 1 is a hydraulic schematic diagram of the present invention.
Figure 3:
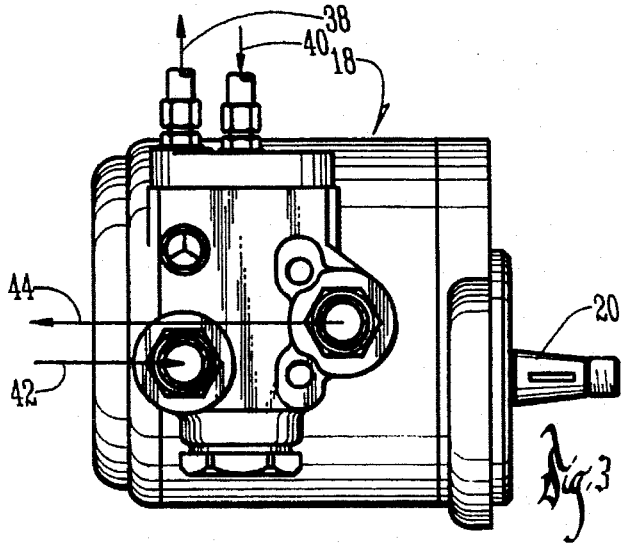
FIG. 3 shows the hydraulic fan motor of the present invention.

FIG. 1 shows a hydraulic schematic diagram of the electrohydraulic controlled cooling system 10 of the present invention. The system 10 includes an internal combustion engine 12 which is used to power vehicles, machinery, or the like. A hydraulic pump 14 is connected to the engine and driven by a belt, splined shaft, etc. The hydraulic pump 14 pumps hydraulic fluid from a reservoir 16 through various hydraulic lines to a hydraulic motor 18 and back through the hydraulic lines to the reservoir 16. The hydraulic motor 18 includes a shaft 20 that is connected to a cooling fan (FIG. 3). The cooling fan is used along with a radiator to cool the engine 12.

Figure 2:
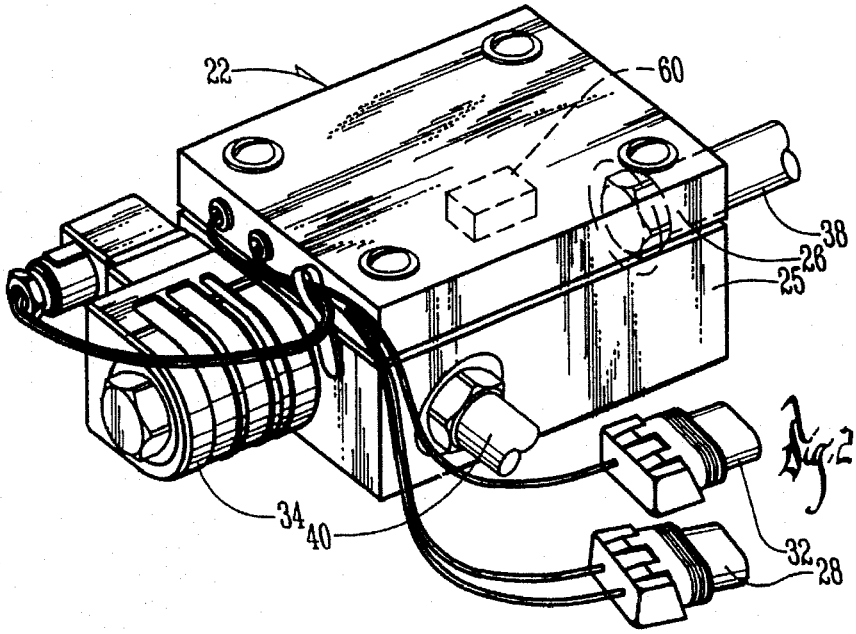
FIG. 2 is an isometric view of the solenoid controlled valve of the present invention.

As shown in FIG. 1, the cooling system 10 includes a solenoid controlled valve 22 (also shown in FIG. 2) and a switching or bypass valve 24. The valves 22 and 24 are connected to the various hydraulic lines as shown in FIG. 1. FIG. 2 shows the solenoid controlled valve 22. The valve 22 includes a housing 25 which encases the valve mechanism and an electronic circuit portion 26. The electronic circuit has a connection means 28 for connection to a 12 volt power supply 30 which supplies power to the circuit 26. The circuit 26 also includes a connection means 32 for receiving an electronic control signal. The electronic circuit 26 is electrically connected to a solenoid 34 which controls the position of the solenoid controlled valve 22.

The system 10 also includes an engine control processor 36. The processor 36 is connected to various sensors which sense conditions present in the engine 12. The processor 36 generates an electronic signal which is connected to the circuit 26 via connection means 32. The solenoid control valve 22 is connected to the switching valve 24 by pilot lines 38 and 40 (FIGS. 1, 2, and 3). The hydraulic motor 18 is connected to the system by hydraulic lines 42 and 44 (FIG. 1 and 3).

The fan control system 10 operates as follows. The engine 12 provides mechanical power to the hydraulic pump 14 which in turn pumps hydraulic fluid from the reservoir 16 through the hydraulic line 42 to the hydraulic motor 18 and back through hydraulic line 44 to the reservoir 16 (FIG. 1). The engine control processor 36 is connected to a plurality of sensors which each sense an engine conditions such as coolant temperature, air temperature, oil temperature, etc. The processor then generates a pulse width modulated (PWM) signal and sends it to the electronic circuit 26 via connections means 32. The circuit 26 takes the PWM signal and uses it to control the solenoid controlled valve 22. The circuit also senses the temperature of the valve 22 since the compression force of the spring in the valve 22 changes slightly with temperature. The circuit 26 adjusts accordingly. The valve 22 controls the hydraulic fluid pressure in the pilot supply line 40 which in turn controls the switching valve 24 on the hydraulic motor 18 which then controls the speed of the motor 18.

For example, when no cooling demand is necessary, the switch valve 24 bypasses the hydraulic fluid flow to the hydraulic return line which results in the hydraulic motor stopping or idling. As pressure increases in the pilot supply line 40, the switching valve 24 increases the hydraulic fluid flow to the motor 18 resulting in an increased fan speed. In other words, the maximum fan speed is obtained when the signal from the engine control processor 36 indicates that maximum cooling is necessary, which causes the solenoid controlled valve 22 to increase the hydraulic fluid pressure in the pilot line 40 which then causes the switching valve 24 to direct maximum hydraulic fluid to the motor 18 causing the fan to operate at its maximum speed. The minimum fan speed is obtained in a similar fashion.

The electronic signal generated by the engine control processor 36 is a 50 Hz (PWM) signal. The duty cycle of the PWM signal varies from 10% to 90%. When a minimum amount of cooling is required, the duty cycle of the PWM signal will be 10%, resulting in the cooling fan idling or being turned off. When the maximum amount of cooling is required, the duty cycle of the PWM will be 90%, resulting in the cooling fan operating at its maximum speed. When any intermediate amount of cooling is required, the duty cycle of the PWM signal will be at a value between 10 and 90%.

Note that any system using the present invention is not limited to using the PWM signals described above. Any type of digital or analog signal provided by an electronic engine control could be used. Also, any frequency could be used.

The present invention is also not limited to the use described above. This control system could be used to control the speed of a hydraulic motor that is associated with another dynamic body. The system could include a sensing means to sense any dynamic condition of the body and a signal generation means to generate a corresponding electronic signal based on the condition sensed. The electronic signal could then control a hydraulic valve which in turn controls the speed of the hydraulic motor.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. The method of controlling the speed of a hydraulic motor for driving a cooling fan for cooling an internal combustion engine wherein said engine has an engine control processor electronically connected to a plurality of engine components, comprising:

sensing a first temperature from at least one temperature source in said engine;

generating an electronic signal in the engine control processor based on said first temperature;

providing a valve control circuit electrically connected to the engine control processor for receiving the electronic signal, said valve control circuit being remotely located from said engine control processor;

evaluating said electronic signal and converting the electronic signal to a valve control signal;

emitting the valve control signal to a solenoid controlled hydraulic valve, wherein said valve will be actuated to change fluid flow of a determined magnitude; and hydraulically connecting said valve to a hydraulic motor operatively coupled to a fan so that the speed of said hydraulic motor and the speed of said fan will be coordinated to provide cooling air to said engine appropriate to deal with the temperature conditions of said engine.

2. The method of claim 1 wherein said electronic signal is a digital signal.

3. The method of claim 2 wherein said digital signal is a pulse width modulated signal.

4. The method of claim 1 further comprising the step of sensing a second temperature from a second temperature source in said engine, wherein said electronic signal is generated from said first temperature and said second temperature.

5. The method of claim 1 wherein said first temperature source is the engine coolant.

6. The method of claim 1 wherein said first temperature source is the engine oil.

7. The method of claim 1 wherein said first temperature source is an engine air passage.

8. The method of claim 1 wherein said first temperature source is the transmission retarder.

9. The method of claim 1 wherein said first temperature source is the hydraulic oil cooler.

10. The method of claim 1 wherein said valve is operatively coupled to said hydraulic motor via a control valve, wherein the speed of said hydraulic motor and the speed of said fan will be controlled by the operating position of said control valve.

11. The method of claim 1 further comprising the step of sensing the temperature of the solenoid controlled hydraulic valve and adjusting the valve control signal accordingly.

12. The method of claim 1 wherein the speed of the fan can have any value between a maximum speed and a minimum speed.

13. The method of controlling a dynamic body, comprising:

sensing a dynamic condition of a dynamic body;

generating an electronic signal based on said dynamic condition;

providing a solenoid controlled hydraulic valve;

sensing a temperature proximate the valve to provide an indication of the temperature of the valve;

evaluating said electronic signal and said temperature of the valve and emitting an output current of a determined value to the solenoid controlled hydraulic valve, whereby said valve will be actuated to change fluid flow of a determined magnitude; and hydraulically connecting said valve to a hydraulic motor operatively associated with said dynamic body so that the speed of said hydraulic motor will influence the dynamic function of said dynamic body.

14. An electrohydraulic fan control comprising:

an internal combustion engine;

an engine control computer electrically connected to a plurality of engine components;

a first temperature sensor electrically connected to the engine control computer and coupled to said engine near a temperature source of said engine;

a valve control circuit electrically connected to the engine control computer, said valve control circuit being remotely located from said engine control computer, said valve control circuit receiving an electronic signal generated by the engine control computer based on the first temperature source and generating a valve control signal based on the electronic signal;

a solenoid controlled hydraulic valve electrically coupled to said valve control circuit, said valve being controlled by the valve control signal generated by said valve control circuit; and a hydraulic motor operatively coupled to a cooling fan, said hydraulic motor being coupled to said solenoid controlled hydraulic valve, wherein said solenoid controlled hydraulic valve controls the speed of said fan based on said valve control signal.

15. The fan control of claim 14 further comprising a second temperature sensor coupled to the solenoid controlled hydraulic valve, wherein said valve control circuit generates the valve control signal based on the electronic signal and the output of the second temperature sensor.

* * * * *